US007002065B2

(12) United States Patent
Petersen

(10) Patent No.: US 7,002,065 B2
(45) Date of Patent: Feb. 21, 2006

(54) CHASSIS FOR AN ELECTRICAL STRINGED MUSICAL INSTRUMENT

(76) Inventor: Neil Petersen, 33 N. Mount Creek Dr., Kila, MT (US) 59920

( * ) Notice: Subject to any disclaimer, the term of this patent is extended or adjusted under 35 U.S.C. 154(b) by 0 days.

(21) Appl. No.: 10/800,120

(22) Filed: Mar. 11, 2004

(65) Prior Publication Data

US 2005/0211051 A1 Sep. 29, 2005

(51) Int. Cl.
*G10D 3/00* (2006.01)

(52) U.S. Cl. ..... 84/290; 84/291

(58) Field of Classification Search ..... 84/290, 84/291, 293, 267, 280, 281, 297 R
See application file for complete search history.

(56) References Cited

U.S. PATENT DOCUMENTS

| | | | | |
|---|---|---|---|---|
| 3,396,621 | A | 8/1968 | Dycus | |
| 3,447,412 | A | 6/1969 | Marshall | |
| 3,657,462 | A | 4/1972 | Robinson | |
| 4,073,211 | A | 2/1978 | Jorgensen | |
| 4,188,850 | A | 2/1980 | Kaman, II | |
| 4,201,108 | A | 5/1980 | Bunker | |
| 4,538,497 | A | 9/1985 | Smith | |
| 4,829,870 | A | 5/1989 | Ralston | |
| 5,929,362 | A | 7/1999 | Oteyza | |
| 6,114,616 | A | 9/2000 | Naylor | |
| 6,194,644 | B1 | 2/2001 | Hendrickson | |
| 6,198,030 | B1 | 3/2001 | Rose | |
| 6,255,567 | B1 | 7/2001 | Minakuchi | |
| 6,262,353 | B1 | 7/2001 | Murray | |
| 6,525,246 | B1 | 2/2003 | Erismann | |
| 2003/0164080 | A1 * | 9/2003 | Childress | 84/291 |

* cited by examiner

*Primary Examiner*—Kimberly Lockett
(74) *Attorney, Agent, or Firm*—Birdwell & Janke, LLP

(57) ABSTRACT

A chassis for a stringed musical instrument such as a guitar is provided such that the chassis may be interchangeably connected with any one of a variety of necks resulting in a tunable and playable unit. This unit may be further attached to any one of a variety of bodies, the body bearing substantially none of the load of the strings' tension.

20 Claims, 2 Drawing Sheets

CHASSIS FOR AN ELECTRICAL STRINGED MUSICAL INSTRUMENT

BACKGROUND OF THE INVENTION

This invention relates to stringed musical instruments and in particular the reconfigurable stringed instrument.

Stringed instruments such as electric guitars are common in the modern musical performance arena, and are available in a wide variety of shapes and styles. Indeed, many serious musicians will own more than one such instrument due to the differing tone qualities and musical effects that may be obtained from different designs and materials of construction. At the same time, electrical guitars can be expensive and players may need to make a substantial monetary investment to obtain the range of instrument types needed for performance of various kinds of music.

Stringed instruments such as guitars have been classically constructed as a single unit comprising a neck and a body, with strings being affixed near the back end of the body (the tailpiece) and near the front end of the neck (the headstock). The strings run over a bridge which elevates them off the substantially flat surface of the instrument and allows them to be struck, picked, or strummed for generation of musical notes. The body is an integral part of the instrument. Various notes are selected by the player through placement of fingers on the strings at locations along the neck on a portion known as the fingerboard. The fingerboard of a guitar generally is a fretboard, where small ridges are provided over which the string is pressed to alter its effective length and thus the frequency of the resulting tone that is generated. Other stringed musical instruments such as violins and cellos are generally not equipped with frets.

In some cases designs for electric guitars have been proposed wherein some portions of the guitar is interchangeable. For example, U.S. Pat. No. 3,396,621, entitled INTERCHANGEABLE NECK ASSEMBLIES FOR ELECTRICAL MUSICAL INSTRUMENTS, proposes a preassembled playable unit having a headstock, a tailpiece and strings mounted thereon which may be disconnected from one body and attached to another body, the bodies containing the electrical pickup for the musical tones generated by the strings. However, this arrangement does not provide for interchangeability of different necks which may also be desired by players due to the differing configurations and styles of fingerboards.

As another example, U.S. Pat. No. 5,929,362, entitled GUITAR WITH A REMOVABLE FRETBOARD AND PICKUP SECTION POWERED BY A HEADPHONE AMPLIFIER, proposes a fretboard and pickup unit having the headstock, the tailpiece, the strings, and the electrical pickup for the string-generated tones. This assembly may be attached to various body units via physical and electrical connections. Yet, again, there is no feature allowing ready interchange of fingerboard and headstock within the unit.

Similarly, U.S. Pat. No. 4,538,497, entitled SOFT BODY GUITAR, proposes a guitar wherein a stem, defining a plane for strings, is detachably secured to a body which may be soft to conform to the contours of a human body sitting or standing. Again, no provision is made for more complete interchangeability of the major components of the musical instrument.

Thus, while the limited interchangeability of some component parts of a stringed instrument has been proposed, the benefits and means for complete interchangeability of the major components of a stringed musical instrument so as to reconfigure the instrument have not heretofore been recognized.

SUMMARY OF THE INVENTION

In view of the foregoing, the present invention addresses the need for enhanced flexibility of component parts of stringed musical instruments and for reduced expense to a musician resulting from such flexibility. It does so by providing a rigid support member having a front portion for receiving a neck of a stringed musical instrument, a back portion for securing at least one string, and a body receiving portion; a bridge disposed on the support member for elevating strings off the surface of the support member; a first attachment mechanism for releasably attaching a neck of a stringed musical instrument at the front portion of the support member; and a second attachment mechanism for releasably attaching a body of a stringed musical instrument at the body receiving portion of the support member. In a preferred embodiment the front portion comprises a recess formed in the support member, and the body receiving portion comprises a surface of the support member on a side thereof opposite the bridge. Preferably, the support member is made of metal.

The invention also provides a reconfigurable stringed instrument having such a chassis, a neck with one or more frets and tuning pegs, a body portion and one or more strings. It further provides a method for assembling such a stringed musical instrument. The ease of disconnecting one neck from the chassis and replacing it with another allows a user to select among various necks for reasons of playability as well as for removing a neck for repair then reattaching it.

The foregoing and other objectives, features, and advantages of the invention will be more readily understood upon consideration of the following detailed description of a preferred embodiment of the invention, taken in conjunction with the accompanying drawings.

DETAILED DESCRIPTION OF A PREFERRED EMBODIMENT

Figure 1:
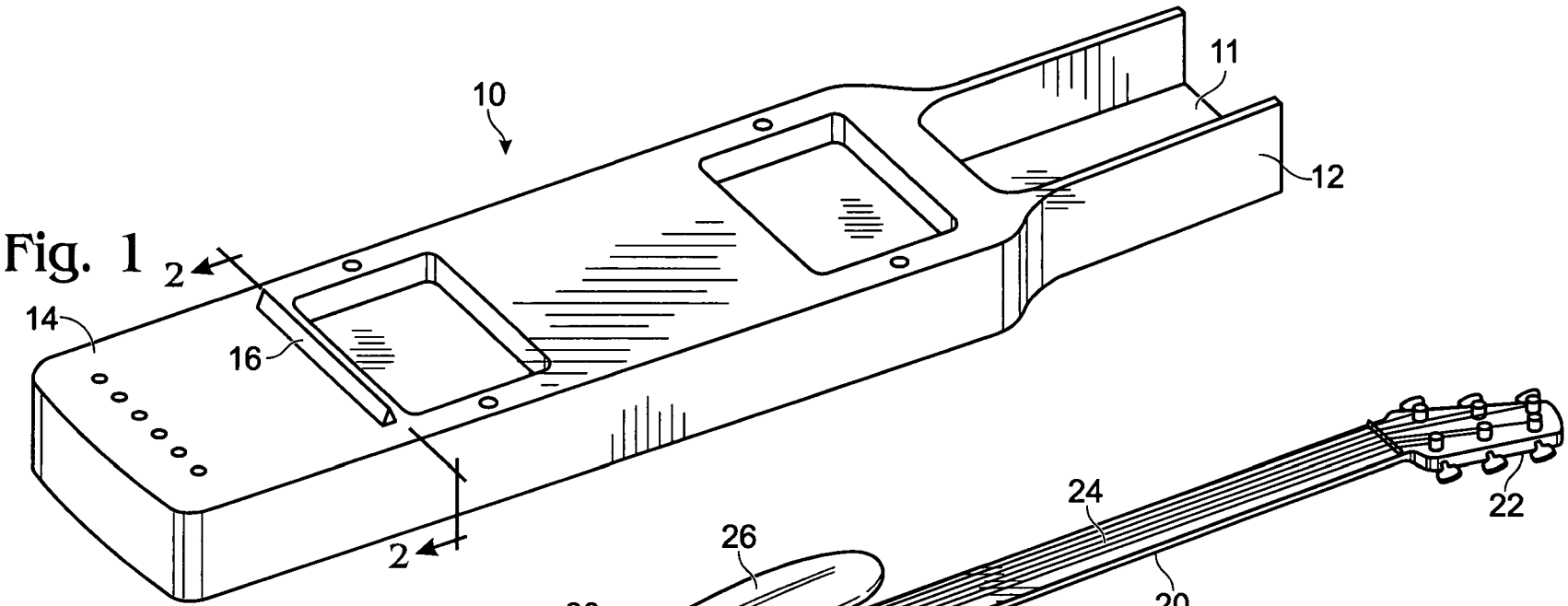
FIG. 1 shows a top perspective of a preferred embodiment of a chassis for a stringed musical instrument, according to the present invention.

A preferred embodiment of the present invention, as shown in FIG. 1, comprises a rigid chassis unit 10 constructed of a stiff material, preferably metal but which could also be a stiff plastic capable of bearing loads, wood, a composite such as graphite-reinforced resin, or even a honey-combed structure. The chassis includes a front por tion 12 for receiving a neck adapted to fit thereon which preferably also includes a recess 11 for affixing the neck, a back portion 14, or "tailpiece," adapted to accept one or more strings attached to the chassis, a bridge 16 disposed on the support member to raise the strings off the surface of the support member, and a body receiving portion 18 (FIG. 2), in this case comprising the surface of the support member opposite the surface bearing the bridge. However, in accordance with the present invention, the body receiving portion could be located elsewhere, such as on a side surface or even on the rear surface of the support members and could have a more complex configuration.

Figures 2, 3:
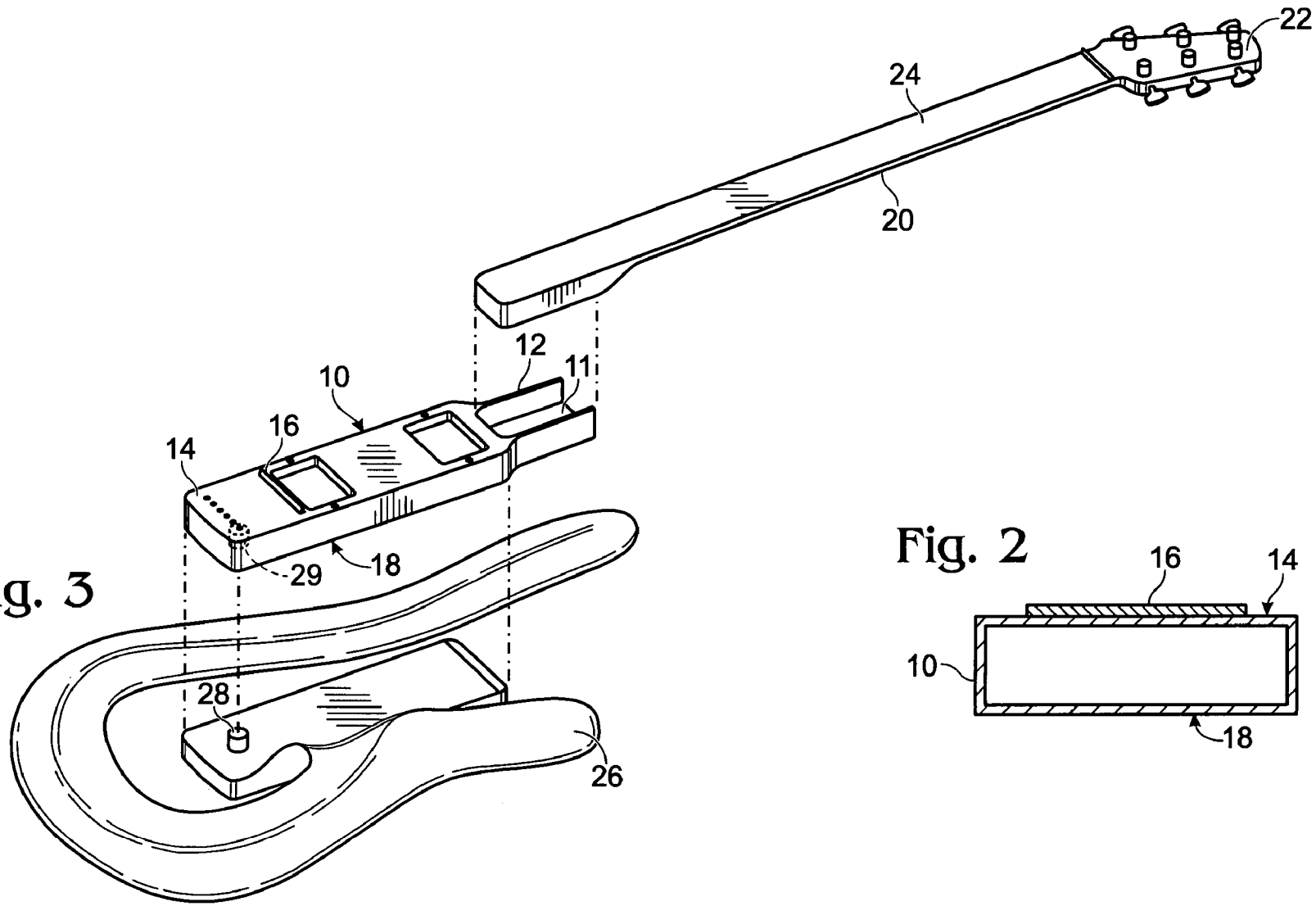
FIG. 2 shows a cross section or cross sectional view of the preferred embodiment of FIG. 1 taken along line 2—2 thereof.
FIG. 3 shows an exploded perspective of the preferred embodiment of a chassis for a stringed musical instrument of FIG. 1 in conjunction with a representative neck unit and body unit.

FIG. 2 is a cross section of the chassis 10, showing that in this preferred embodiment the bridge 16 and body receiving portion 18 are disposed on opposite sides of the chassis.

As shown in FIG. 3, the neck unit 20 is adapted to fit into a recess 11 of and attach to the front portion 12 of the chassis 10, and may be secured in position by any of a number of fasteners well known in the art, including screws, bolts, clamps or other devices capable of forming a strong and rigid joint between the chassis 10 and the neck 20, but capable of detachment as well. By this means a variety of neck types and designs can be substituted on chassis 10 by the expedient of detaching one and attaching another using the above-mentioned fasteners. The neck unit 20 includes the headstock 22 where the ends of the strings opposite to the tailpiece 14 are affixed, and may contain tuning pegs for tightening and tuning the strings. Neck unit 20 also includes fingerboard 24.

Figure 4:
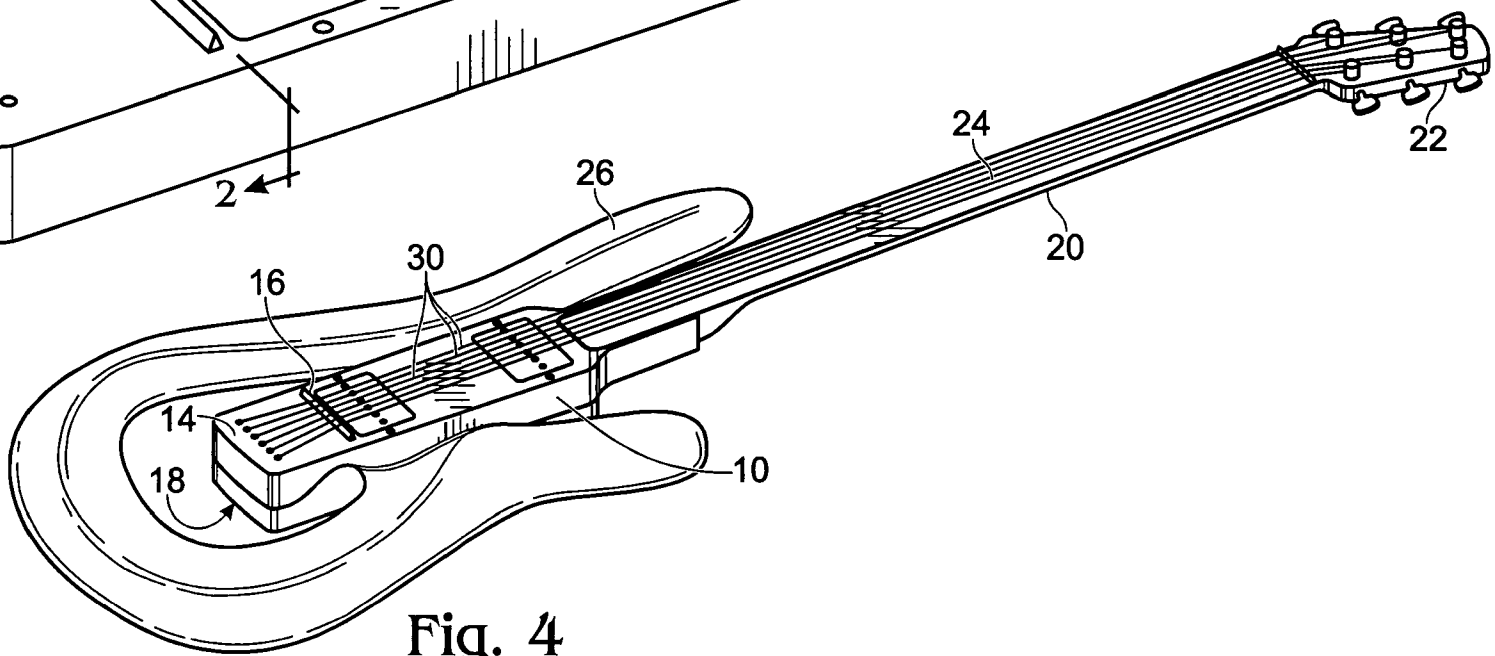
FIG. 4 shows a perspective of the preferred embodiment of a chassis for a stringed musical instrument of FIG. 1, assembled into an electric guitar.

As shown in FIG. 4, once the neck unit 20 has been attached to the chassis 10, strings 30 may be put into place and tightened to the appropriate degree to provide the proper tuning for the instrument. The neck unit 20 is equipped with a fingerboard for selection of the notes to be played. Preferably, this fingerboard is equipped with frets, but in accordance with the present invention the fingerboard may be smooth, as in a violin. As is further shown in FIG. 4, a body 26 may be attached to the body receiving portion 18 of chassis 10; however, the assembly of chassis 10, neck unit 20 and strings 30 is fully playable as this sub-assembly of the guitar bears substantially all the tension load of the strings needed for the strings to generate musical tones when played by picking, strumming or striking.

It is to be understood that, in the case of an electric stringed instrument such as an electric guitar, the pickups for the sound generated by the strings must be located physically near the strings, and thus are likely to be disposed on the chassis 10, but it is in accordance with the present invention if they are located on the neck unit 20 or the body 26 as well. The invention also contemplates that there preferably be an electrical connection formed upon attachment of the body 26 to the chassis 10 via the body receiving portion 18, such that the electrical signals generated by the pickups in response to the mechanical vibration of the strings can be relayed to amplifiers and speakers. The electrical connection may be made by a variety of means, such as a mating plug 28 and socket 29 pair, as shown in FIG. 3.

The terms and expressions which have been employed in the foregoing specification are used therein as terms of description and not of limitation, and there is no intention, in the use of such terms and expressions, of excluding equivalents of the features shown and described or portions thereof; it being recognized that the scope of the invention is defined and limited only by the claims which follow. It will doubtless be obvious to those of ordinary skill in the art that there are other embodiments employing these principles that are not described in detail herein.

I claim:

1. A chassis for a stringed musical instrument, comprising:

a top side, the top side having a front portion for receiving a neck of a stringed musical instrument and a back portion for securing at least one string;

a body receiving portion, said body receiving portion consisting essentially of a basal side of said chassis disposed opposite said top side of the chassis;

a bridge disposed on said top side for elevating strings off the surface thereof;

a first attachment mechanism for releasably attaching a neck of a stringed musical instrument at the front portion of said top side; and a second attachment mechanism for releasably attaching a body of a stringed musical instrument at the body receiving portion of said chassis.

2. The chassis of claim 1, wherein said chassis is made of metal.

3. The chassis of claim 1, wherein the front portion comprises a recess formed in said top side of said chassis.

4. The chassis of claim 3, wherein said chassis is made of solid material.

5. The chassis of claim 4, wherein the solid material is metal.

6. The chassis of claim 3, wherein the body receiving portion is substantially flat.

7. The chassis of claim 6, wherein said chassis is made of solid material.

8. The chassis of claim 7, wherein the solid material is metal.

9. The chassis of claim 7, wherein the second attachment mechanism comprises a threaded aperture in said basal side of said chassis.

10. The chassis of claim 7, wherein the first attachment mechanism comprises a threaded fastener.

11. The chassis of claim 7, further comprising one or more slots formed in the back portion thereof for receiving respective strings.

12. The chassis of claim 1, further comprising one or more slots formed in the back portion thereof for receiving respective strings.

13. A stringed musical instrument including the chassis of claim 1 and further comprising a neck attached to the chassis at the front portion thereof, a body attached to the chassis at the body receiving portion thereof, said body having no substantial contact with said chassis except at said body receiving portion, and at least one string, affixed at one end to the back portion of the chassis and at the opposing end to the neck, said at least one string passing over the bridge and being under tension sufficient for generating a musical tone.

14. The stringed musical instrument of claim 13, wherein the neck includes a fingerboard over which said at least one string passes.

15. The stringed musical instrument of claim 14, wherein the fingerboard is equipped with frets.

16. The stringed musical instrument of claim 14, wherein the neck is equipped with a headstock and tuning pegs.

17. The stringed instrument of claim 16, wherein the chassis is constructed of metal.

18. The stringed instrument of claim 13, wherein the chassis is constructed of metal.

19. The stringed instrument of claim 13, wherein the neck is equipped with a headstock and tuning pegs.

20. A method for assembling a stringed instrument, comprising:

providing a chassis having a top side having a front portion for receiving a neck of a stringed musical instrument and a back portion for securing at least one string and a body receiving portion, said body receiving portion consisting essentially of a basal side of said chassis disposed opposite said top side of the chassis;

providing a bridge disposed on said top side of the chassis for elevating strings off the surface thereof;

attaching a neck of a stringed musical instrument at the front portion of the chassis;

attaching a body of a stringed musical instrument at the body receiving portion of the chassis, such that said body has no substantial contact with said chassis except at said body receiving portion thereof; and securing said at least one string between the neck and the back portion of the chassis, said at least one string passing over the bridge and being under tension sufficient for generating a musical tone.

* * * * *